US005720629A

United States Patent [19]

Self, Jr. et al.

[11] Patent Number: 5,720,629

[45] Date of Patent: Feb. 24, 1998

[54] SEALED ELECTRICAL CONNECTOR

[75] Inventors: Daines Milfred Self, Jr., Oak Ridge; Michael Paul Trull, Winston-Salem, both of N.C.

[73] Assignee: The Whitaker Corporation, Wilmington, Del.

[21] Appl. No.: 733,059

[22] Filed: Oct. 16, 1996

[51] Int. Cl.[6] ..... H01R 13/40

[52] U.S. Cl. ..... 439/587; 439/274

[58] Field of Search ..... 439/271–277, 439/279, 587, 589

[56] References Cited

U.S. PATENT DOCUMENTS

| | | | |
|---|---|---|---|
| 4,090,759 | 5/1978 | Herrmann, Jr. | 439/279 |
| 4,349,241 | 9/1982 | Juris et al. | 339/143 R |
| 4,420,210 | 12/1983 | Karol et al. | 339/94 M |
| 4,611,873 | 9/1986 | Punako et al. | 439/277 |
| 4,662,692 | 5/1987 | Uken et al. | 339/96 |
| 4,711,509 | 12/1987 | Cross et al. | 439/587 |
| 4,806,123 | 2/1989 | Konishi et al. | 439/595 |
| 4,921,437 | 5/1990 | Cooper et al. | 439/275 |
| 5,240,433 | 8/1993 | Kato | 439/587 |
| 5,266,045 | 11/1993 | Yamamoto et al. | 439/275 |
| 5,545,062 | 8/1996 | Takagishi et al. | 439/275 |
| 5,595,496 | 1/1997 | Konda et al. | 439/271 |
| 5,609,496 | 3/1997 | Kilmer et al. | 439/271 |
| 5,618,206 | 4/1997 | Sawada et al. | 439/587 |

FOREIGN PATENT DOCUMENTS

| | | | |
|---|---|---|---|
| 8705157 | 8/1987 | European Pat. Off. | 439/275 |

*Primary Examiner*—Neil Abrams
*Assistant Examiner*—Katrina Davis
*Attorney, Agent, or Firm*—Robert J. Kapalka

[57] ABSTRACT

An electrical connector comprises a housing defining a plurality of cavities which extend into the housing through a face thereof, and a seal member mountable on the face of the housing. The seal member is a unitary body which includes a flange and a plurality of plugs extending axially from one side of the flange. The plugs are arrayed in correspondence with the plurality of cavities and are dimensioned for sealing engagement in respective ones of the cavities. The seal member has a plurality of openings extending through the flange and through respective ones of the plugs. The openings are dimensioned to permit insertion of respective conductors through the openings and into the cavities when the seal member is mounted on the housing, and withdrawal of the conductors back out through the openings.

9 Claims, 4 Drawing Sheets

SEALED ELECTRICAL CONNECTOR

FIELD OF THE INVENTION

The invention relates to an electrical connector which is sealed to prevent entry of water and contaminants.

BACKGROUND OF THE INVENTION

Electrical connectors are often used in environments where they are exposed to dust and dirt, and may even be used in environments where they are subject to splash or immersion in water. When these contaminants enter an electrical connector housing, contacts in the housing may become coated with contaminants or corroded by oxidation, thereby leading to intermittent and unreliable electrical connections. Many types of seals and sealed connectors are known to keep contaminants from entering an electrical connector housing.

U.S. Pat. No. 5,240,433 discloses a waterproof electrical connector including a connector housing having a plurality of cylinders each of which accommodates a terminal in the housing. A cap or retainer is installed on an open end of the housing. The retainer has a plurality of openings which are aligned with the plurality of cylinders, and around each of the openings is a lip which secures a waterproof plug to the retainer at each of the openings. The plugs are dimensioned to enter the cylinders when the retainer is installed on the housing and to provide a watertight seal against the cylinder inner walls. Each of the plugs has a central opening through which a terminal on a wire is insertable, and the opening is dimensioned to provide a watertight seal on the wire when the terminal is installed therethrough.

A problem with this sealing arrangement is that each of the plugs is a separate element which must be individually attached to the retainer. This requires a separate assembly step which must be repeated for each of the cylinders in the housing, and as the number of cylinders becomes greater the time and expense of assembly becomes greater. There is a need for a sealed electrical connector which overcomes the problems of the prior art design.

SUMMARY OF THE INVENTION

It is an object of the invention to simplify the assembly of a sealed electrical connector.

It is another object of the invention to improve the sealing effectiveness in a sealed electrical connector.

These and other objects are accomplished by an electrical connector comprising:

a housing defining a plurality of cavities which extend into the housing through a face thereof and which are adapted to receive respective conductors therein; and a seal member mountable on the face of the housing, the seal member being a unitary body including a flange and a plurality of plugs extending axially from one side of the flange, the plugs being arrayed in correspondence with the plurality of cavities and being dimensioned for sealing engagement in respective ones of the cavities, the seal member having a plurality of openings extending through the flange and through respective ones of the plugs, the openings being dimensioned to permit insertion of the respective conductors through the openings and into the cavities when the seal member is mounted on the housing.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
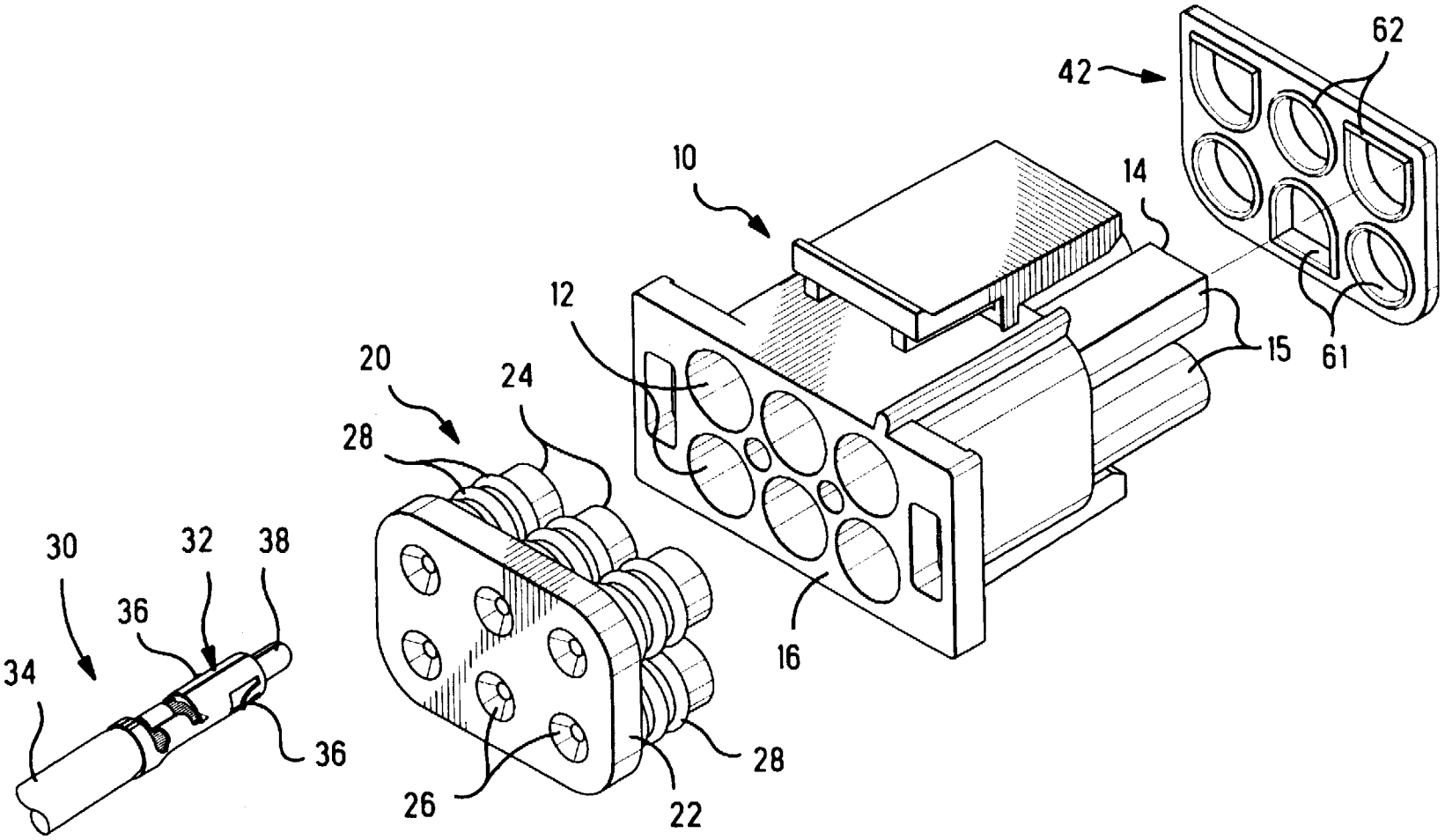
FIG. 1 is an exploded isometric view of a sealed electrical connector according to the invention, along with a conductor poised for insertion therein.
Figure 2:
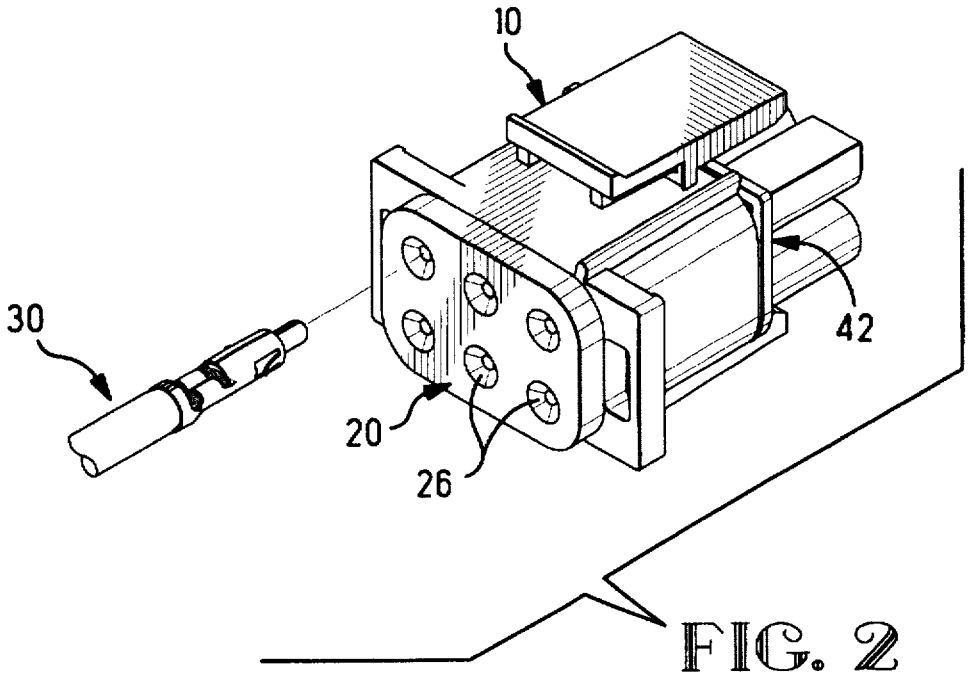
FIG. 2 is a view of the connector in assembled condition.

With reference to FIGS. 1 and 2, a sealed electrical connector according to the invention comprises a connector housing 10 and a seal member 20. The connector housing 10 is a dielectric body which has a plurality of cavities 12 extending therethrough from a front face 14 to a rear face 16. Each of the cavities 12 is shown to have a cylindrical cross-section as it enters the rear face, although other cross-sectional shapes are encompassed within the scope of the invention.

The seal member 20 is a unitary body which is made from an appropriate elastomeric material such as silicon rubber. The seal member includes a flange 22 which has a plurality of plugs 24 projecting axially from one side thereof. The plugs 24 are arrayed in correspondence with the cavities 12 in the housing and are dimensioned for sealing engagement in respective ones of the cavities. The seal member has a plurality of openings 26 which extend through the flange and extend axially through individual ones of the plugs 24. The seal member 20 is mountable on the rear face 16 with the plugs 24 disposed in the cavities.

A respective conductor 30 is insertable through each of the openings 26 and into each of the cavities 12 to form one half of an electrical connector assembly. The conductor 30 includes a terminal 32 which is crimped or otherwise attached to one end of a conductive wire 34 which is enclosed within a sheath of insulation. The terminal 32 has lances 36 which are engageable behind a shoulder on a wall of the cavity 12 to retain the terminal in the housing. The terminal 32 is illustrated as a pin terminal having a forward pin section 38 which is matable with a socket section of a corresponding socket terminal (not shown) in a cap connector housing. However, it should be understood that the invention can be utilized with either a plug connector housing or a cap connector housing, and the invention is normally utilized with both halves of a mating connector assembly. Also, the invention contemplates that both pin terminals and socket terminals can be mixed in a single connector housing.

Figure 3:
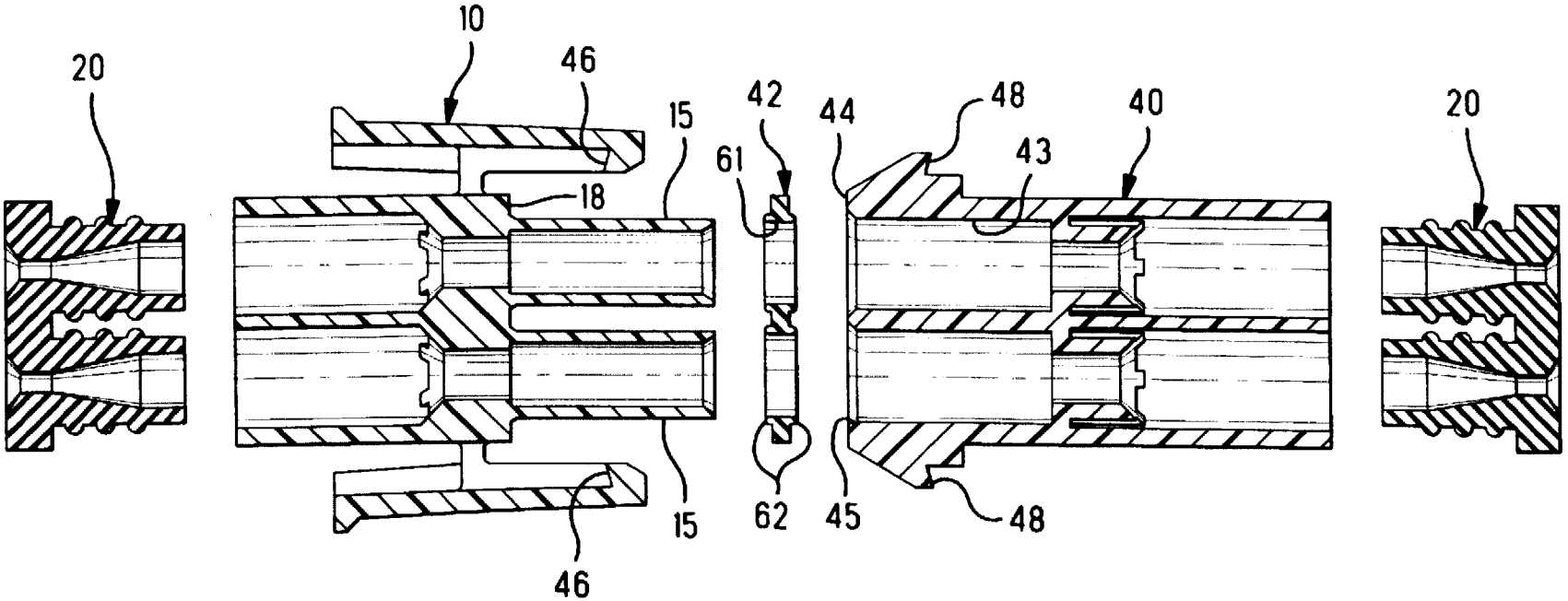
FIG. 3 is an exploded cross-sectional view through a mating pair of sealed electrical connectors which comprise an electrical connector assembly.

As shown in cross-section in FIG. 3, the plug connector housing 10 which holds the pin terminals is matable with a cap connector housing 40 which holds socket terminals, and the seal members 20 are mountable on the rear faces of both connector housings 10,40 to seal both ends of the connector assembly. The plug connector housing 10 has silos 15 which enter respective wells 43 in the cap connector housing 40, and an interfacial seal 42 is provided to seal an interface between the plug and cap connector housings As shown in FIGS. 1 and 3, the interfacial seal 42 is a relatively flat unitary body which is made of elastomeric material preferably has a durometer between twenty and twenty-five. The interfacial seal 42 has a plurality of apertures 61 extending therethrough which are dimensioned to receive the silos 15 of the plug connector 10. The interfacial seal is compressed between surface 18 on the housing 10 and surface 44 on the housing 40 when the housings are secured together by latches 46 which engage behind tabs 48. The interfacial seal 42 has ridges 62 of material which surround a periphery of each of the apertures 61 on each side of the interfacial seal. When the connector housings 10 and 40 are mated, the ridges 62 on one side of the interfacial seal enter beveled entranceways 45 of the wells 43 and are compressed between the silos 15 and the walls of the entranceways 45, thereby sealing around the silos 15.

Figure 4:
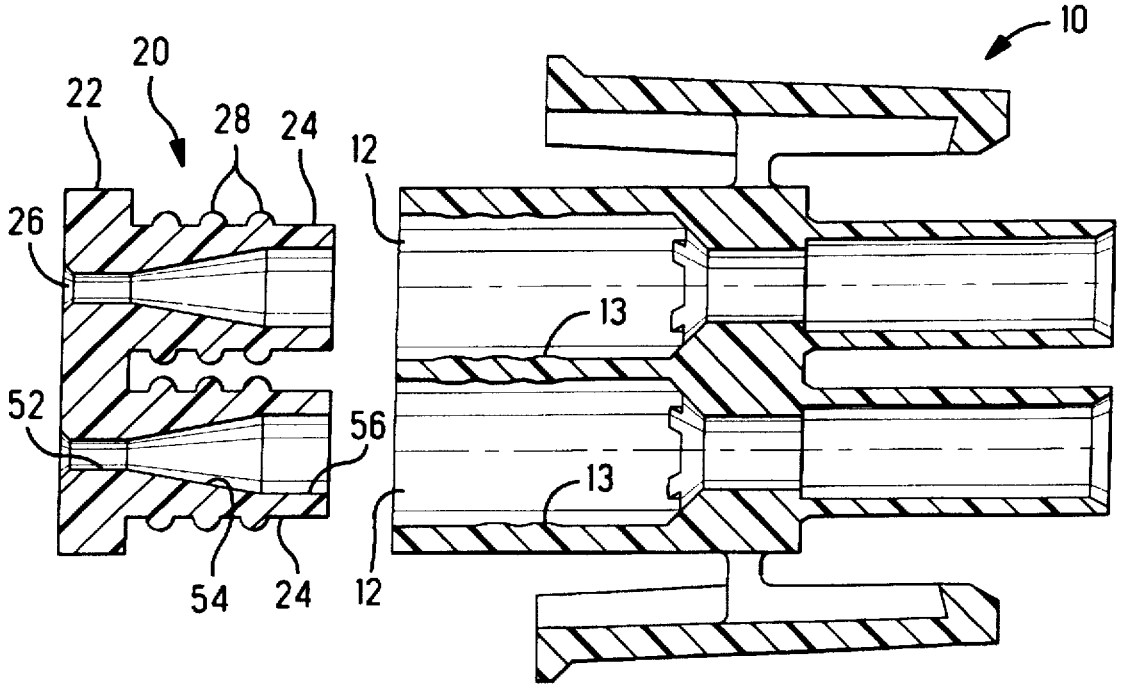
FIG. 4 is an exploded cross-sectional view through the sealed electrical connector.

With reference to FIGS. 1 and 4, each of the plugs 24 of the seal member 20 has an outer surface which includes at least one integrally formed ring or projection 28. In the illustrated embodiment, each of the plugs has three rings 28. The rings on each plug have an outer diameter which is greater than the diameter of the cavity corresponding to that plug. When the plugs are installed in the cavities 12, the rings 28 are compressed and deformed to provide a seal with the wall of each cavity, as shown in the lower cavity in FIG. 5. The seal member 20 is retained to the housing by frictional resistance of the plugs in the cavities. Further, the wall of each cavity 12 is configured with waves or pull rings 13 which result from the molding process used to produce the cavities 12 in the connector housing 10. The pull rings 13 cooperate with the rings 28 on the plugs 24 to provide a watertight seal as will be explained.

Figure 5:
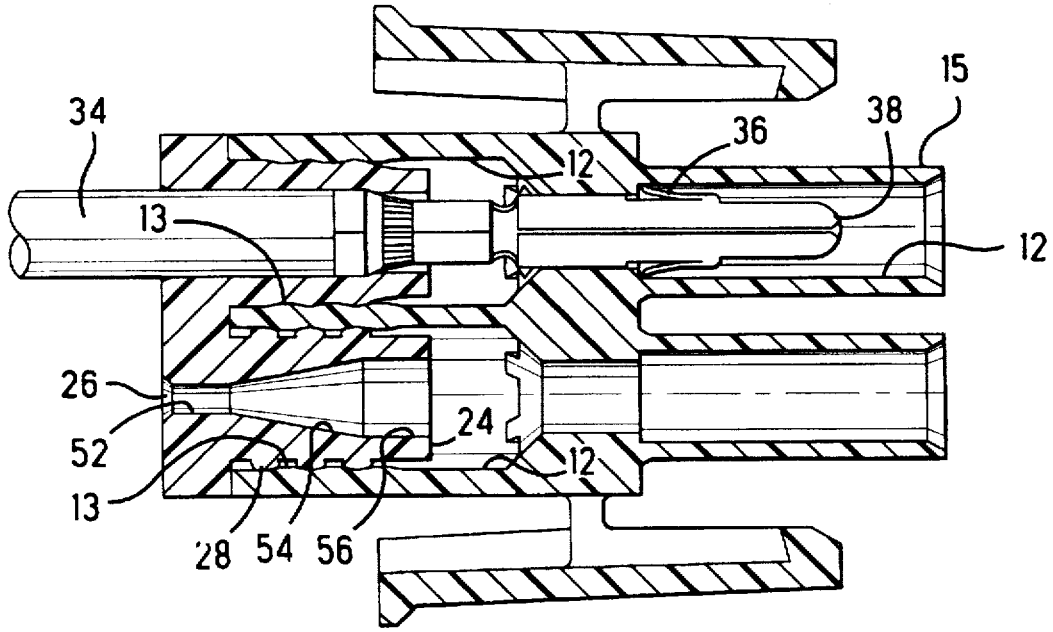
FIG. 5 is a cross-sectional view showing the sealed electrical connector with a conductor installed therein.

Referring now to FIGS. 4 and 5, each of the openings 26 has a cross-sectional dimension which varies over the length of the opening through the seal member 20. A portion 52 of each opening through the flange 22 is dimensioned with a cross-section which is significantly smaller than the cross-section of the wire 34 which is sealed therein. A flared portion 54 of the opening widens in cross-section as it extends through the plug 24, and an end portion 56 of the opening has a constant cross-section which is approximately the same as the cross-sectional dimension of the wire.

After the seal member 20 is installed on the connector housing 10, the terminals 32 which have been crimped to the wires 34 are inserted through the openings 26 in the flange 22 and through the plugs 24 into their associated cavities 12. The material of the seal member 20 is selected for appropriate deformability and resilience to permit the terminals to pass through the openings without tearing the seal member and without providing extreme resistance to passage of the terminals. The seal member 20 preferably has a durometer between thirty and thirty-five. Also, the size of the opening 26 is selected so that the wire 34 which becomes disposed in the opening urges the plug 24 radially outwardly against the wall of the cavity 12 with a tight fit. As shown in FIG. 5, the upper plug has been deformed such that the rings 28 are squashed into the troughs between the pull rings 13 and are blended into a compressed mass to provide an effective seal against contaminants and water in particular.

The seal member 20 also permits one or more of the terminals 32 to be withdrawn out of the connector through the seal member while the seal member is still mounted on the connector. By inserting a tool into the cavity 12 from the end of the silo 15, the lances 36 can be released from behind the shoulder, and the terminal 32 can be pulled back out through the opening 26 in the seal member 20 without tearing the seal member.

The invention has the advantages that an electrical connector housing having a plurality of terminal-receiving cavities can be sealed by a seal member having a plurality of plugs which are gang-insertable into the cavities. The seal member is formed as a ready-to-use unitary body which does not require prior assembly. The seal member has openings which permit terminals to be installed through the seal and into the cavities when the seal member is mounted on the connector housing, and individual terminals can also be withdrawn from the connector back out through the openings while the seal member remains on the housing.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a housing defining a plurality of cavities which extend into the housing through a face thereof and which are adapted to receive respective conductors therein; and a seal member mountable on the face of the housing, the seal member being a unitary body including a flange and a plurality of plugs extending axially from one side of the flange, the plugs being arrayed in correspondence with the plurality of cavities and being dimensioned for sealing engagement in respective ones of the cavities, the seal member having a plurality of openings extending through the flange and through respective ones of the plugs, the openings being dimensioned to permit insertion of the respective conductors through the openings and into the cavities when the seal member is mounted on the housing, wherein each of the openings extends into the flange from side opposite the one side and has a narrow portion which extends through the flange with a cross-sectional dimension that is less than a cross-sectional dimension of its respective said conductor, a flared portion which extends from the narrow portion with an increasing cross-sectional dimension, and an end portion remote from the flange which has a cross-sectional dimension that is approximately the same as the cross-sectional dimension of said respective conductor.

2. The electrical connector according to claim 1, wherein each of the plugs has an outer surface which includes at least one integrally formed ring.

3. The electrical connector according to claim 2, wherein each of the cavities is bounded by a wall surface which includes at least one molded pull ring.

4. The electrical connector according to claim 1, wherein individual ones of the conductors can be withdrawn through the openings when the seal member is mounted on the housing.

5. The electrical connector according to claim 1, further comprising an interfacial seal which is mounted on the housing for sealing engagement with a mating connector.

6. The electrical connector according to claim 5, wherein the interfacial seal has apertures which are dimensioned to receive respective silos of the housing.

7. The electrical connector according to claim 6, wherein one side of the interfacial seal includes respective ridges surrounding each of the apertures.

8. A seal member for sealing around conductors which enter cavities in an electrical connector housing through a face thereof, the seal member comprising:

a unitary seal body including a flange and a plurality of plugs extending axially from one side of the flange, the plugs being arrayed in correspondence with the plurality of cavities and being dimensioned for sealing engagement in respective ones of the cavities, the seal body having a plurality of openings extending through the flange and through respective ones of the plugs, the openings being dimensioned to permit insertion of the conductors through respective ones of the openings and into the cavities when the seal body is mounted on the housing, wherein each of the openings extends into the flange from a side opposite the one side and has a narrow portion which extends through the flange with a cross-sectional dimension that is less than a cross-sectional dimension of a respective said conductor, a flared portion which extends from the narrow portion with an increasing cross-sectional dimension, and an end portion remote from the flange which has a cross-sectional dimension that is approximately the same as the cross-sectional dimension of said respective conductor.

9. The seal member according to claim 8, wherein each of the plugs has an outer surface which includes at least one integrally formed ring.

* * * * *